US006192661B1

(12) United States Patent
Bodart et al.

(10) Patent No.: US 6,192,661 B1
(45) **Date of Patent: *Feb. 27, 2001**

(54) RETURN ENVELOPE ASSEMBLY

(75) Inventors: Joseph C. Bodart, Grayslake; Donald J. Rozmarin, Lake Zurich, both of IL (US)

(73) Assignee: R. R. Donnelley & Sons, Downers Grove, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/841,249

(22) Filed: Apr. 29, 1997

(51) Int. Cl.[7] ..... B65B 43/26

(52) U.S. Cl. ..... 53/492; 53/381.3; 53/381.2; 414/412

(58) Field of Search ..... 229/301, 302, 229/303, 305, 306, 70, 92.1, 92.3, 71, 75, 315; 53/381.3, 381.5, 492, 381.2, 381.1; 414/412

(56) References Cited

U.S. PATENT DOCUMENTS

| | | | | |
|---|---|---|---|---|
| 479,555 | | 7/1892 | Carroll . | |
| 863,688 | | 8/1907 | Albree . | |
| 1,265,159 | | 5/1918 | Alexander . | |
| 1,467,803 | | 9/1923 | Mautner . | |
| 1,588,875 | | 6/1926 | Curtis . | |
| 2,196,461 | | 4/1940 | Heywood . | |
| 2,402,821 | | 6/1946 | Kosteling . | |
| 2,835,434 | | 5/1958 | Watson . | |
| 2,840,295 | | 6/1958 | Fromm . | |
| 2,840,296 | | 6/1958 | Fromm . | |
| 2,858,061 | | 10/1958 | Fromm et al. . | |
| 2,964,233 | * | 12/1960 | McFarland | 229/302 |
| 2,985,464 | * | 5/1961 | McFarland | 229/70 X |
| 3,104,800 | * | 9/1963 | Johnson et al. | 229/70 |
| 3,141,603 | * | 7/1964 | Whitman | 229/70 |
| 3,270,948 | * | 9/1966 | Donovan | 229/302 |
| 3,406,894 | * | 10/1968 | Settle | 229/70 |
| 4,081,127 | * | 3/1978 | Steidinger | 229/301 X |
| 4,308,987 | | 1/1982 | Solomon . | |
| 4,332,346 | | 6/1982 | Kronman . | |
| 4,333,300 | * | 6/1982 | Russell | 53/381.3 |
| 4,487,360 | | 12/1984 | Fisher et al. . | |
| 4,565,317 | | 1/1986 | Kranz . | |
| 4,595,138 | | 6/1986 | Kristel . | |
| 4,730,767 | | 3/1988 | Gedron . | |
| 4,730,768 | | 3/1988 | Gendron . | |
| 4,915,287 | * | 4/1990 | Volk et al. | 229/301 X |
| 5,156,515 | * | 10/1992 | Charron et al. | 53/381.3 |
| 5,175,979 | * | 1/1993 | Van Der Werff et al. | 53/381.3 |
| 5,366,146 | | 11/1994 | Haan et al. . | |
| 5,458,284 | | 10/1995 | Haan et al. . | |
| 5,474,414 | * | 12/1995 | Tovini et al. | 53/381.3 |
| 5,852,918 | * | 12/1998 | Hidding et al. | 53/381.3 |

* cited by examiner

*Primary Examiner*—Eugene Kim
(74) *Attorney, Agent, or Firm*—Marshall, O'Toole, Gerstein, Murray & Borun

(57) ABSTRACT

In order to ensure the prompt processing of payments of bills with personal checks while using automatic mail opening equipment, a return envelope assembly includes a front panel and a rear panel each having a top edge, a bottom edge, and a pair of side edges. The front and rear panels are integral along their bottom edges about a bottom fold line about which they may be folded so as to have their inner surfaces lie in confronting relation after the envelope is formed from a one piece blank. A side flap is integral with each of the side edges of the front panel about respective side fold lines which are structured such that the side flaps may be folded inwardly to lie between the confronting inner surfaces of the front and rear panels. The side flaps are secured to the inner surface of the rear panel using an adhesive and a closure flap is provided to seal an opening defined by the top edges of the front and rear panels. With this arrangement, the side flaps each have a minimum lateral spacing from an innermost edge to an opposite one of the side fold lines or side edges less than the width of a personal check to prevent it from becoming lodged between one of the side flaps and the rear panel.

8 Claims, 4 Drawing Sheets

RETURN ENVELOPE ASSEMBLY

FIELD OF THE INVENTION

The present invention is generally directed to various aspects of envelope construction and, more particularly, a return envelope for the payment of a bill with a personal check.

BACKGROUND OF THE INVENTION

For many years, it has been well known to utilize envelopes for a wide variety of purposes. The most common use, of course, is for mailing materials that are inserted within the envelope to an intended recipient of the materials. Typically, the envelope will be sealed by gluing the flap after the materials have been inserted into the envelope.

Over the years, the construction of envelopes has evolved to meet the demands of various applications. For example, it was proposed very early in Carroll U.S. Pat. No. 479,555, issued Jul. 26, 1892, to provide a combined promissory note and envelope which may be made from a single piece of paper. Subsequently, Albree U.S. Pat. No. 863,688, issued Aug. 20, 1907, proposed a pay envelope and voucher formed from a blank of paper. Later, Kosteling U.S. Pat. No. 2,402,821, issued Jun. 25, 1946, disclosed a two-way envelope for returning a banking depositor's receipt and also making the next deposit. Subsequently, Fromm U.S. Pat. No. 2,840,295, issued Jun. 24, 1958, disclosed a banking envelope having individually separable forms. As for other early examples, see U.S. Pat. Nos. 1,265,159; 1,467,803; 1,588,875; 2,196,461; 2,835,434; 2,840,296; and 2,858,061. While generally representative of the evolution of envelope construction, serious problems have nonetheless remained.

As representative of the more recent evolution of envelope construction, see U.S. Pat. Nos. 4,487,360; 4,730,767; 4,730,768; 5,366,146; and 5,458,284. These patents all relate to various forms of two-way envelopes, i.e., envelopes that by way of example may include an outgoing mailer, a business return envelope, a payment coupon and a statement or the like. With particular reference to the '767, '146, and '284 patents, they each disclose a form of what has become commonly known as a bangtail panel removable from a return envelope along a tear-off line.

As shown in the '284 patent, the bangtail panel may typically include promotional material which has become commonplace in the mailing of credit card statements. As specifically shown in FIG. 18 of the '284 patent, the bangtail panel 17*b* may be separated from the return envelope panel 12*b* by using the perforation line 9*b*.

Despite the advancements that have been made as represented by the more recent patents, envelopes are known to have seams that are created when the flap and panels are folded and adhesively secured. These seams would seem to be a relatively by-product of the manufacturing process, particularly where the envelope is well formed and the seams are securely joined by adhesive. However, even when this is the case, the seams can be a problem for the recipient of an envelope having an insert that is to be handled by automated equipment.

In particular, there have been serious problems in connection with the processing of return envelopes that are utilized for payment in the credit card industry. Each credit card company processes an enormous volume of mail every month when credit card holders make payment utilizing a return envelope assembly that has been provided for this purpose. Conventionally, the credit card holder will return a payment coupon together with a personal check that must be removed from the return envelope assembly for processing.

Due to the enormous volume of such payments, the credit card companies must be able to utilize automatic mail opening equipment in order to provide timely handling for the contents thereof. Such automatic mail opening equipment typically causes the top of the return envelope to register and be slit, following which each of the sides of the return envelope are similarly caused to register and be slit so that the return envelope can be opened along the fold line which exists between the front and rear panels thereof. After the top and sides sequentially register and are slit, the envelope drops into a trough and a vacuum pulls the front and rear panels open so that the envelope assumes a generally V-shape.

At this point in the automated procedure, the front and rear panels of the envelope each enter a guide and the inserts (e.g., the payment coupon, personal check, etc.) also enter a guide. The guides for the front and rear panels maintain them in a generally V-shape whereas the guide for the payment coupon/personal check maintains them generally equidistant and between the front and rear panels. At a downstream location, a belt grabs the inserts, i.e., the payment coupon, personal check, etc., and delivers them for processing, and the remainder of the return envelope is discarded.

For credit card companies, the inserts need to be processed at the earliest possible moment since the credit card holder may, e.g., be credited with payment as early as the date of receipt of the return envelope. It will be understood that credit card companies process personal checks worth extremely significant amounts in the aggregate and any delay in depositing these checks is a critical cost factor. Unfortunately, the time for depositing the checks is longer than desirable in view of a problem that is well known in connection with the use of automatic mail opening equipment to process the return envelopes.

More specifically, the return envelope is conventionally formed with side flaps that are quite small in width and are folded inwardly between the front and rear panels. The small size makes sense from one point of view inasmuch as minimizing the dimensions of the various portions of the return envelope including the side flaps, saves on the cost of materials, but there are practical restrictions on the size and relative dimensioning of envelopes due to postal regulations which include a minimum width requirement as well as a requirement that envelopes be within a certain "aspect ratio." As for the aspect ratio, this is the term used for the width of an envelope in relation to its height, and the requirement is that this must be between 1.3 and 2.5.

If an envelope is of a size having an aspect ratio outside this range, there is a surcharge that is added since it is considered "non-standard mail." The same holds true for the minimum width requirement, i.e., for any envelope having a width less than 5 inches. As a result, designers of envelopes have tried to maintain a balance as to the minimization of material and meeting the requirements for standard mail as defined by postal regulations.

In so doing, the return envelopes that have been utilized in most cases by credit card companies have assumed a relatively standard configuration. This has included providing side flaps of minimum width in envelopes that are used by credit card companies and, more specifically, where the spacing between the innermost edge of the side flaps to the opposite edge of the envelope is greater than the width of a standard personal check, i.e., 6 inches. However, the personal check can easily be caught between the side flap and the rear panel so that it is not properly processed by the automatic mail opening equipment.

When this occurs, the personal check is drawn with the rear panel by the vacuum and then proceeds with the rear panel into its guide rather than with the guide for the inserts as intended. To detect this problem, the automatic mail opening equipment is provided with a sensor that detects the presence of more than a single thickness in the location of the rear panel after it has entered its guide. Specifically, the sensor is set to look for more than a single thickness in the region of the rear panel between the innermost edges of the side flaps. If the check has been caught between one of the side flaps and the rear panel due to shifting while it has been in transit, the sensor will detect more than a single thickness and will shut down the line for manual removal of the envelope. In practice, it is understood that some credit card companies have experienced shut downs on an average of approximately one out of every 25 envelopes that pass through the automatic mail opening equipment.

As previously mentioned, the difficulty is encountered due to the spacing between the innermost edges of the side flaps in relation to the opposite side edges of the envelope. When that spacing is greater than the width of a standard personal check, the check can shift to one side edge as it is being transported in the mail and then back again to a point where it becomes lodged between one of the side flaps and the rear panel to which it is adhesively secured. In fact, and as mentioned, this occurs with such great frequency that the automatic mail opening equipment is shut down on an average of one out of every 25 envelopes processed.

The present invention is directed to overcoming one or more of the foregoing problems and achieving one or more of the resulting objects.

SUMMARY OF THE INVENTION

It is a principal object of the present invention to provide a new and improved envelope that overcomes at least some of the problems encountered with prior constructions. It is also an object of the present invention to provide a return envelope assembly that is fully suited for use with automatic mail opening equipment. It is an additional object of the present invention to provide a return envelope assembly that prevents personal checks from becoming lodged between a side flap and rear panel.

Accordingly, the present invention is directed to a return envelope assembly for the payment of a bill with a personal check wherein the return envelop assembly is prepared entirely from a one piece blank that includes a front panel and a rear panel each having a top edge, a bottom edge, and a pair of side edges. The front and rear panels are integral along their bottom edges about a bottom fold line with the front panel having an inner surface which lies in confronting relation with an inner surface of the rear panel after the envelope is formed. Further, the return envelope assembly includes a side flap integral with each of the side edges of the front panel about respective side fold lines about which the side flaps are folded inwardly to lie in a position between the confronting inner surfaces of the front and rear panels after the envelope is formed.

With this construction, the return envelope also includes means for securing each of the side flaps to the inner surface of the rear panel so as to be integral therewith. It still additionally includes means for sealing an opening defined by the top edges of the front and rear panels after removal of the extension panel. Moreover, the return envelope assembly is such that the side flaps each have a minimum lateral spacing in relation to the opposite side of the envelope less than the width of the personal check.

In an exemplary embodiment, the front and rear panels are generally rectangular in shape, and the means for closing the opening comprises a closure flap integral with the top edge of the front panel. It is also advantageous for the means for securing the side flap to comprise a permanent adhesive, and for the side flaps to each be formed such that they have generally parallel innermost edges thereon. With this arrangement, the innermost edges are separated from the opposite side edges by the minimum lateral spacing that is less than the width of the personal check entirely therealong.

In a highly preferred embodiment, the minimum lateral spacing between the side flaps and the opposite side edges is on the order of approximately at least ¼ inch less than the width of the personal check for the payment of the bill. Most advantageously, the minimum lateral spacing is on the order of at least approximately five percent less than the width of the personal check for the payment of the bill.

In another respect, the present invention is directed to a bangtail envelope assembly for the payment of a credit card bill with a personal check wherein the bangtail envelope assembly is prepared entirely from a one piece blank. The bangtail envelope assembly is identical in nearly every respect to the return envelope assembly previously described with the exception that it incorporates a removable bangtail panel wherein the bangtail panel and rear panel are integral along their top edges about a second fold line. Still more specifically, the second fold line preferably comprises a perforated line for separating the bangtail panel from the envelope prior to mailing a payment coupon, personal check and the bangtail in the envelope.

With this arrangement, the side flaps each preferably have their free edge positioned inwardly of the side edges of the front and rear panels of the envelope. The free edges on the side flaps also advantageously span a majority of the distance between the top and bottom edges of the front and rear panels. Still additionally, the bangtail envelope assembly preferably has an aspect ratio of between 1.3 and 2.5 and a minimum width of approximately 5 inches.

Other objects, advantages and features of the present invention will become apparent from a consideration of the following specification taken in conjunction with the accompanying drawings.

DETAILED DESCRIPTION OF THE PREFERRED EMBODIMENT

Figure 1:
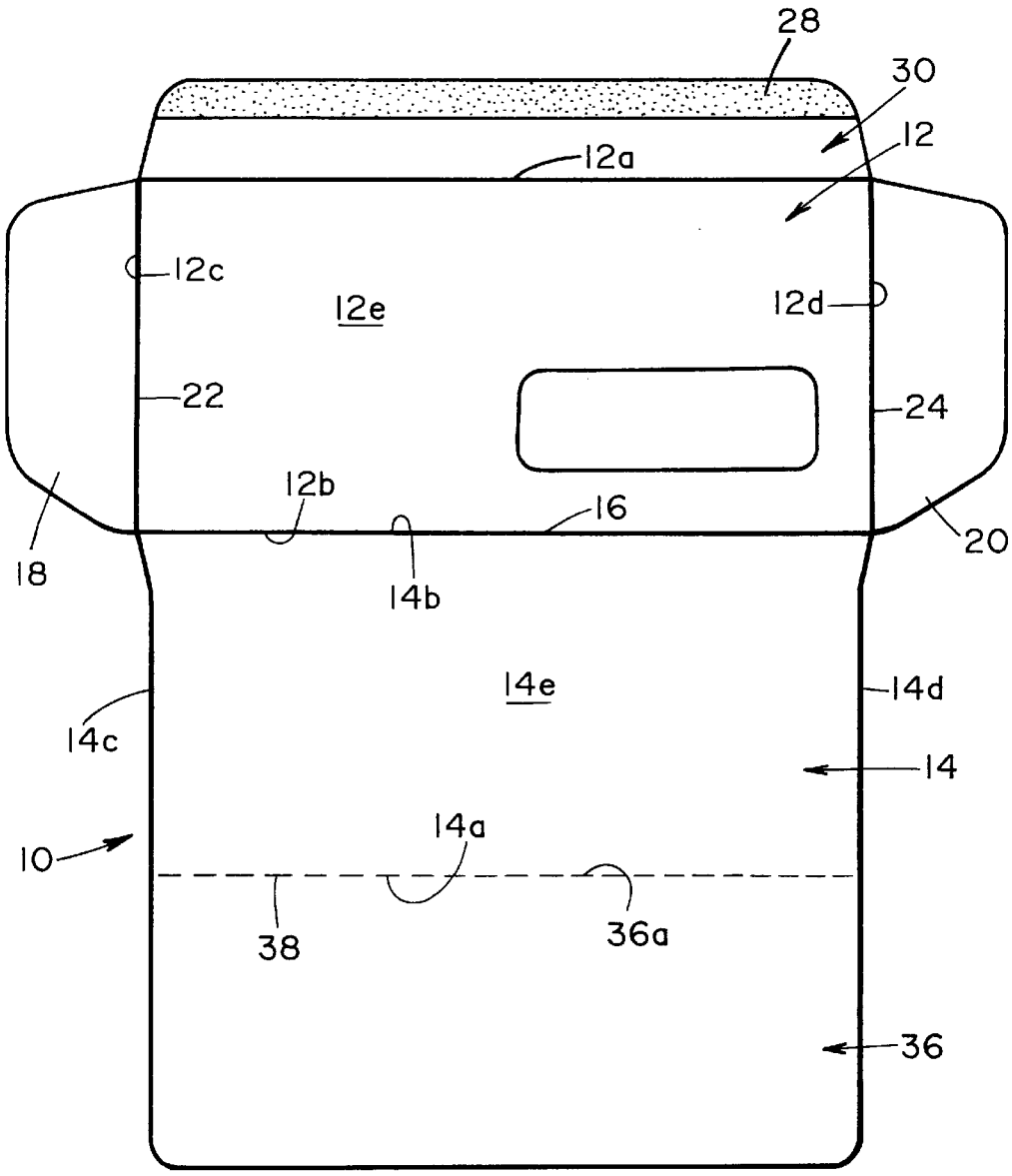
FIG. 1 is a plan view of a one piece blank that has been die cut to form a return envelope assembly that has features which are in accordance with the present invention.
Figure 2:
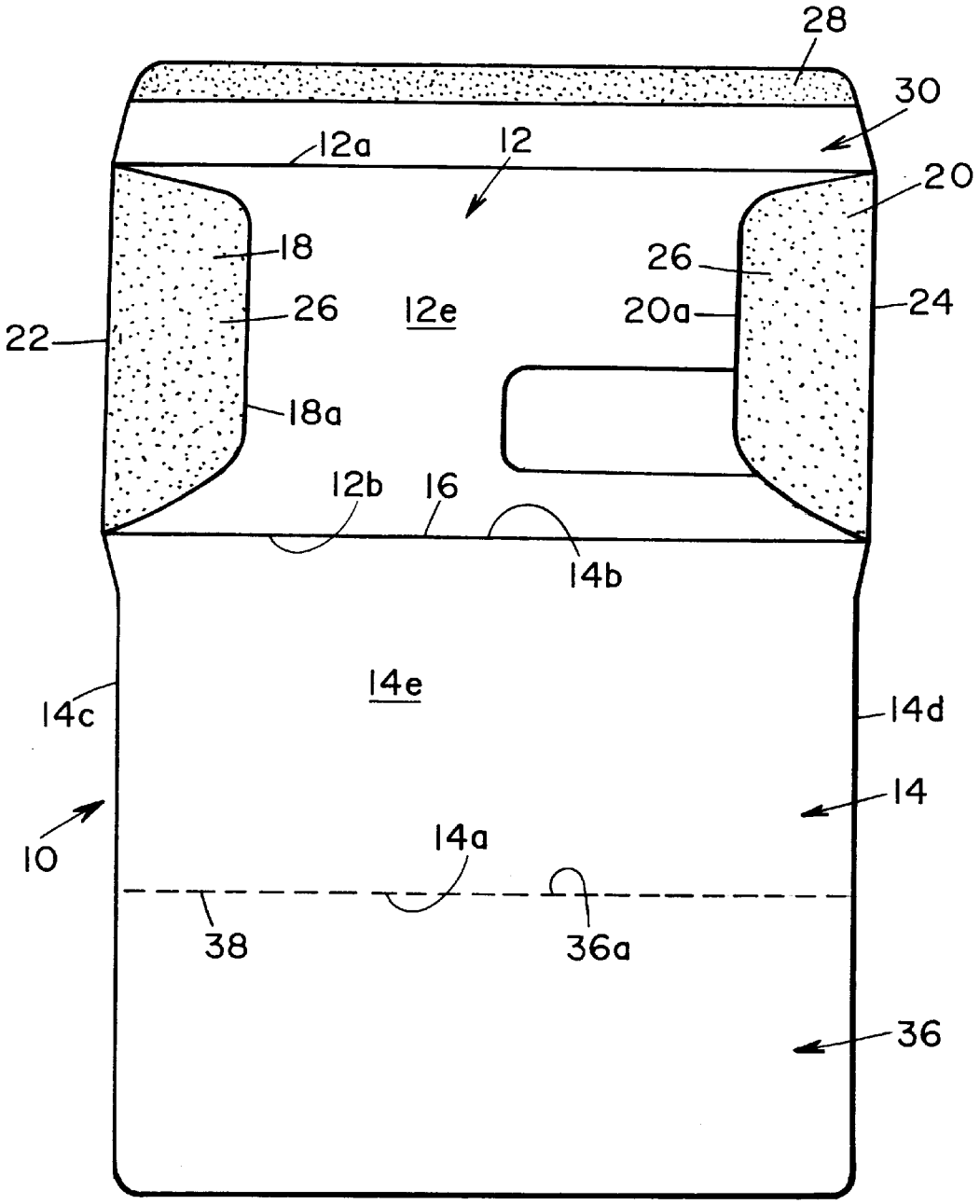
FIG. 2 is a view similar to FIG. 1 showing side flaps which have been folded over an inner surface of a front panel after a one piece blank has been die cut into the form shown in FIG. 1.
Figure 3:
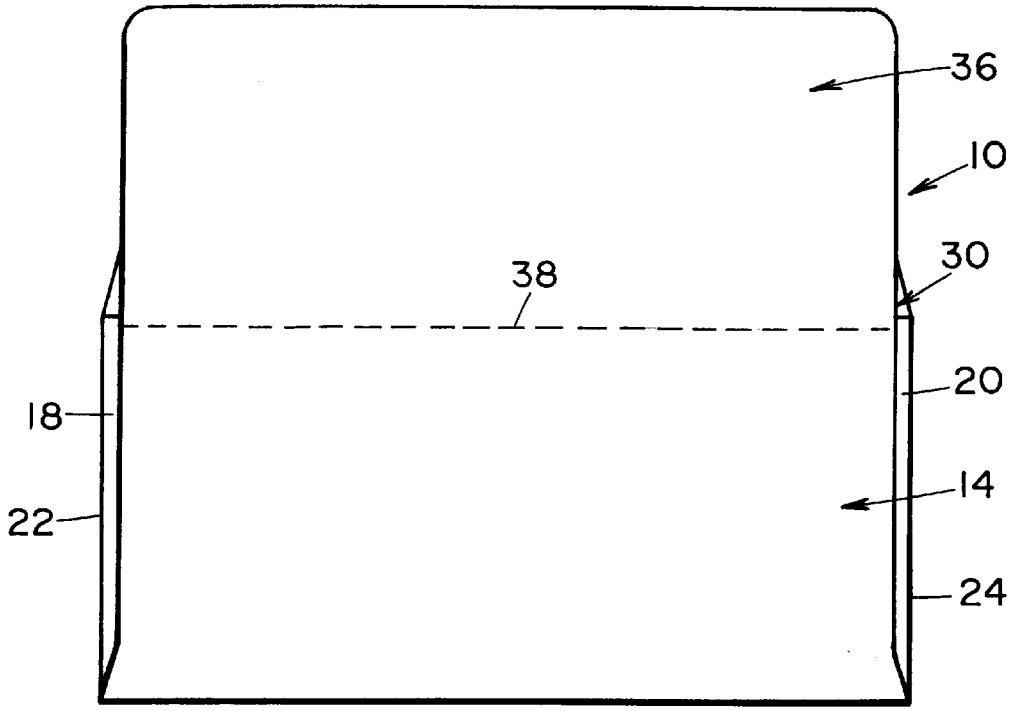
FIG. 3 is a view similar to FIG. 2 showing a rear panel which has been folded over the side flaps after the side flaps have been folded over the front panel.

In the illustrations given, and with reference first to FIG. 1, the reference numeral 10 designates generally a return envelope assembly for the payment of a bill with a personal check wherein the return envelope assembly 10 is prepared entirely from a one piece blank that includes a front panel 12 and a rear panel 14. The front and rear panels 12 and 14 each have a top edge 12*a* and 14*a*, respectively, a bottom edge 12*b* and 14*b*, respectively, and a pair of side edges 12*c*, 12*d* and 14*c*, 14*d*, respectively with the front and rear panels being integral along their bottom edges 12*b* and 14*b* about a bottom fold line 16 such that the front panel 12 has an inner surface 12*e* which lies in confronting relation with an inner surface 14*e* of the rear panel 14 after the envelope 10 is formed. Further, the return envelope assembly 10 includes side flaps 18 and 20 integral with the side edges 12*c* and 12*d* of the front panel 12 about respective side fold lines 22 and 24 about which the side flaps are folded inwardly to lie between the confronting inner surfaces 12*e* and 14*e* of the front and rear panels 12 and 14 (see FIGS. 2 and 3).

With this construction, the return envelope also includes means such as a permanent adhesive as at 26 for securing each of the side flaps 18 and 20 to the inner surface 14*e* of the rear panel 14 so as to be integral therewith. It still additionally includes means such as a moisture activated glue 28 on a closure flap 30 for sealing an opening defined by the top edges 12*a* and 14*a* of the front and rear panels 12 and 14. Moreover, the return envelope assembly 10 is such that the side flaps 18 and 20 each have a minimum lateral spacing in relation to their opposite side edges 24 and 22 less than the width of a personal check (see dimension lines 32 and 34, respectively).

In the embodiment illustrated in FIGS. 1–5, the front and rear panels 12 and 14 are generally rectangular in shape and the closure flap 30 is integral with the top edge 12*a* of the front panel 12 in conventional fashion. It is advantageous for the side flaps 18 and 20 to each be formed such that they have generally parallel innermost edges 18*a* and 20*a* thereon. With this arrangement, the innermost edges 18*a* and 20*a* are separated from their opposite side edges 24 and 22 by the minimum lateral spacing that is less than the width of the personal check entirely therealong (see dimension lines 32 and 34).

In a highly preferred embodiment, the minimum lateral spacing is on the order of at least approximately ¼ inch, or at least approximately five percent, less than the width of a standard personal check of the type normally used for the payment of a bill.

In another important respect, the return envelope assembly 10 incorporates what is conventionally known as a bangtail for removal from the envelope before the payment of a credit card bill with a personal check. The bangtail return envelope assembly simply incorporates a removable bangtail panel 36 wherein the bangtail panel 36 and rear panel 14 are integral along their top edges 14*a* and 36*a* about a second fold line 38. Still more specifically, the second fold line 38 preferably comprises a perforated line for separating the bangtail panel 36 from the envelope 10 prior to mailing a payment coupon, personal check and the bangtail panel in the envelope 10.

In still other respects, the side flaps 18 and 20 each preferably have their free edges 18*a* and 20*a* positioned inwardly of the side edges 22 and 24 of the front and rear panels 12 and 14. The innermost portions of the free edges 18*a* and 20*a* on the side flaps 18 and 20 also advantageously span a majority of the distance between the top and bottom edges 12*a*, 14*a* and 12*b*, 14*b* of the front and rear panels 12 and 14. Still additionally, the bangtail envelope assembly 10 is preferably formed so as to have an aspect ratio of between 1.3 and 2.5 and a minimum width of approximately five inches.

Figure 4:
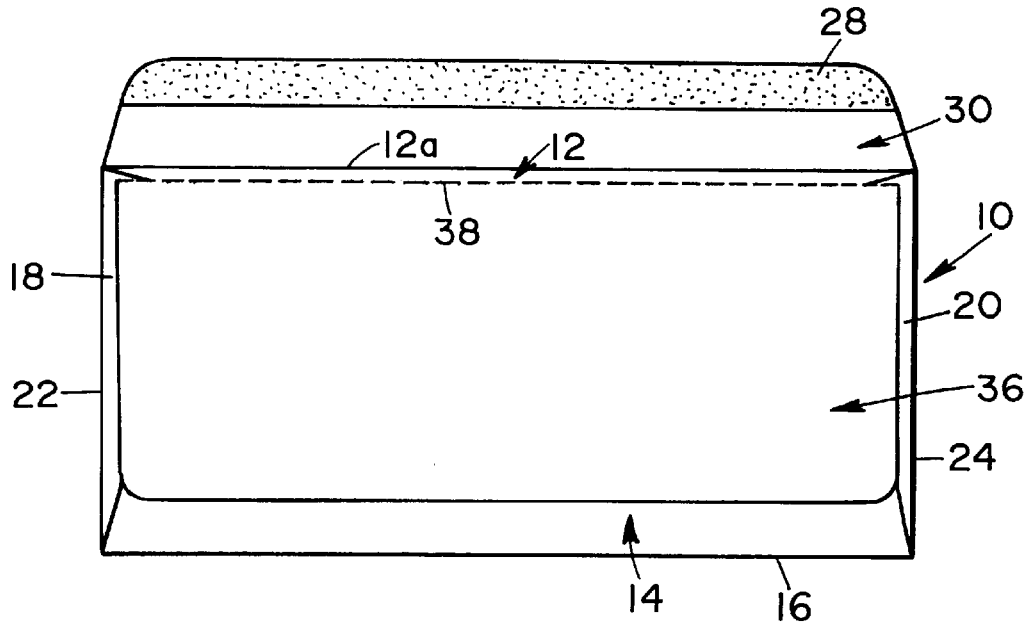
FIG. 4 is a view similar to FIG. 3 showing an extension panel which has been folded over the rear panel after the rear panel has been folded over the side flaps.

Referring to FIG. 4, the bangtail panel 36, which may also be characterized as an extension panel, is shown folded over the rear panel 14 after the rear panel 14 has been folded over the side flaps 18 and 20. It is conventional in the credit card industry for the bangtail or extension panel 36 to have advertising, promotional, and/or order form information for products and the like. With this arrangement, the bangtail or extension panel 36 can be removed for use or removed and discarded prior to sealing the envelope 10 by using the adhesive 28 on the closure flap 30.

Figure 5:
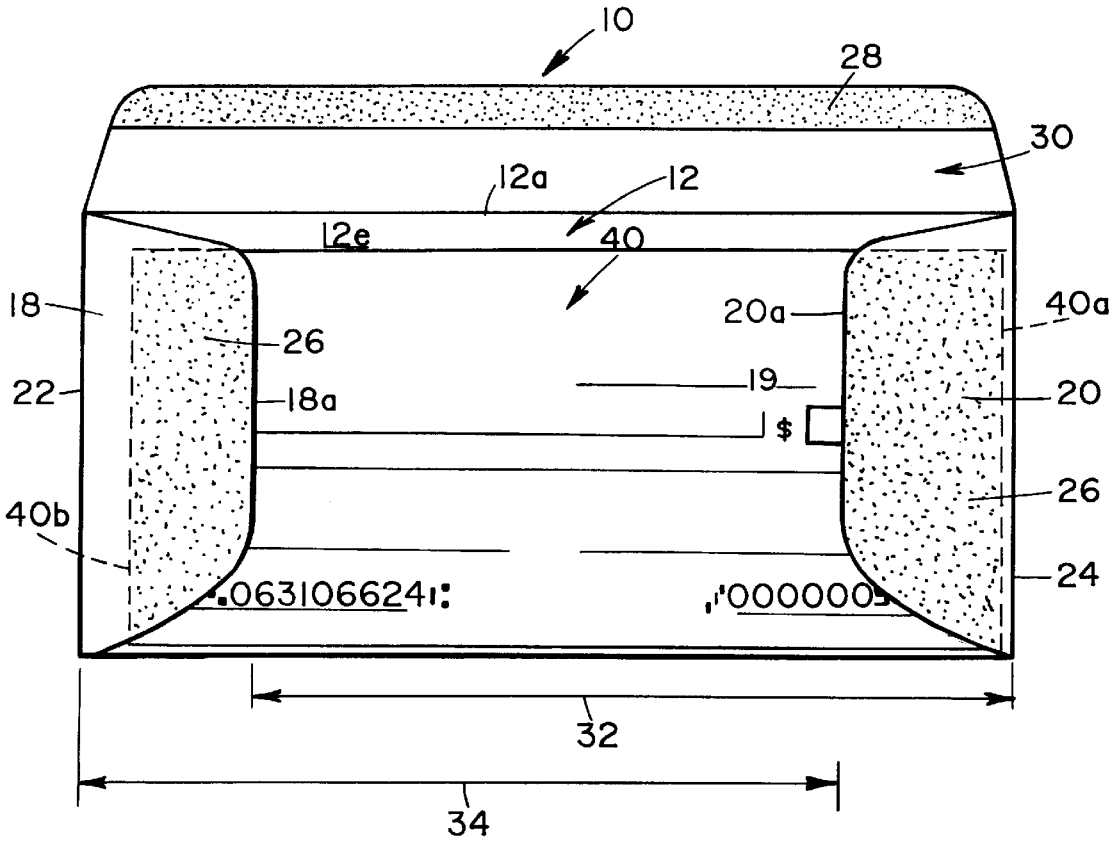
FIG. 5 is a view similar to FIG. 4 with the rear panel and extension panel removed and a personal check disposed between the side flaps and front panel.

With reference now to FIG. 5, the unique aspect of the present invention is clearly illustrated by reason of the positioning of a personal check 40 within the envelope 10 where it is shifted to have one of its side edges 40*a* immediately adjacent the side edge 24. It will be seen that the opposite side edge 40*b* of the personal check 40 extends considerably beyond the innermost edge 18*a* of the side flap 18 in a direction toward the opposite side edge 22 of the envelope 10. Assuming the personal check 40 has been properly placed between the front panel 12 and the side flaps 18 and 20, there is no way for it to shift such that one of its side edges 40*a* or 40*b* can become lodged between one of the side flaps 18 and 20 and the rear panel 14.

As is well recognized in the field, personal checks are almost universally of a standard size, i.e., 6 inches in width. This makes it possible to utilize the benefits of the present invention by controlling the minimum lateral spacing from the innermost edges 18*a* and 20*a* of the side flaps 18 and 20 to the opposite side edges 24 and 22 of the envelope 10 so as to ensure that a personal check such as 40 will not become lodged between one of the side flaps 18 and 20 and the rear panel 14 of the envelope 10. Moreover, other necessary or desirable inserts such as a payment coupon and a bangtail panel can also be dimensionally controlled.

In other words, and specifically in relation to the credit card industry, the payment coupon and bangtail panel can be formed to have respective widths that are approximately equal to the standard width of a personal check. This serves to ensure that none of the contents of a return envelope assembly for the payment of a credit card bill will inadvertently become lodged between one of the side flaps and the rear panel of the return envelope assembly while in transit. On the contrary, due to the control of the minimum lateral spacing of the innermost edges of the side flaps in relation to the opposite side edges of the envelope, the contents of the return envelope assembly stay correctly positioned.

Since the contents are correctly positioned, they properly enter the guide that is provided for them, rather than being captured in one of the guides for the front and rear panels of the envelope, after it has been slit by the automatic mail opening equipment so that, at a downstream location, a belt can properly grab the contents, i.e., the payment coupon, personal check, and bangtail panel, and automatically deliver them for processing.

Due to the unique aspects of the present invention, it is now possible for the first time to avoid the frequent intermittent disruptions to operation of the automatic mail opening equipment thereby ensuring prompt processing of payments made to credit card companies at the earliest possible moment since there is no longer any realistic possibility that the contents of a return envelope assembly will become improperly lodged where they cannot be handled as intended.

While in the foregoing there has been set forth a preferred embodiment of the invention, it will be appreciated that the details herein given may be varied by those skilled in the art without departing from the true spirit and scope of the appended claims.

What is claimed is:

1. A method of using automatic mail opening equipment to automatically process an insert contained in a return envelope, the method comprising the steps of:

receiving the insert in a return envelope having top, bottom and side edges that define rectangularly shaped front and rear panels and a generally rectangularly shaped side flap integral with one of the front and rear panels at each of the side edges of the return envelope, wherein the side flaps each have a minimum lateral spacing from an innermost edge to an opposite one of the side edges of the return envelope such that the minimum lateral spacing is less than the width of the insert, and wherein the insert is disposed in the return envelope between the side flaps and the other of the front and rear panels;

registering the top edge of the return envelope;

slitting the top edge of the return envelope;

registering the side edges of the return envelope;

slitting the side edges of the return envelope;

separating the front and rear panels from the insert; and automatically removing the insert.

2. The method of claim 1, wherein the step of separating the front and rear panels from the insert includes the step of separating the front and rear panels to form substantially a V-shape.

3. The method of claim 1, further comprising the step of locating the front and rear panels in respective first and second guides after separating the front and rear panels from the insert.

4. The method of claim 3, further comprising the step of locating the insert in a third guide disposed generally between the first and second guides in which the front and rear panels are located.

5. A method of automatically processing an insert including at least a standard personal check contained in an envelope, the method comprising the steps of:

receiving the insert including at least the standard personal check in an envelope having rectangularly shaped front and back panels and generally rectangularly shaped side flaps, wherein the side flaps are each integral with one of the front and back panels at one of the opposite side edges of the envelope, wherein the side flaps each have a minimum lateral spacing from an innermost edge of the side flap to the opposite side edge of the envelope such that the minimum lateral spacing is less than the width of the insert including at least the standard personal check, and wherein the insert including at least the standard personal check is disposed in the envelope between the side flaps and the other of the front and back panels;

registering the top edge of the envelope;

slitting the top edge of the envelope;

registering the side edges of the envelope;

slitting the side edges of the envelope;

separating the front and back panels from the insert including at least the standard personal check; and automatically removing the insert including at least the standard personal check.

6. The method of claim 5, wherein the step of separating the front and back panels from the insert including at least the standard personal check includes the step of separating the front and back panels to form substantially a V-shape.

7. The method of claim 5, further comprising the step of locating the front and back panels in respective first and second guides after separating the front and back panels from the insert including at least the standard personal check.

8. The method of claim 7, further comprising the step of locating the insert in a third guide disposed generally between the first and second guides in which the front and back panels are located.

* * * * *